US009004927B2

(12) United States Patent
Yu et al.

(10) Patent No.: US 9,004,927 B2
(45) Date of Patent: Apr. 14, 2015

(54) LOW-PROFILE ELECTRICAL CONNECTOR WITH IMPROVED MOUNTING PIECES FOR RESISTING IMPACT FORCE

(71) Applicant: Alltop Electronics (Suzhou) Co., Ltd, Taicang, JiangSu (CN)

(72) Inventors: Wang-I Yu, Jhonghe (TW); Hung-Chi Tai, Jhonghe (TW); Chun-Hsien Wu, Jhonghe (TW); Siu-Mien Yang, Jhonghe (TW)

(73) Assignee: Alltop Electronics (Suzhou) Ltd., Taichung (CN)

( * ) Notice: Subject to any disclaimer, the term of this patent is extended or adjusted under 35 U.S.C. 154(b) by 38 days.

(21) Appl. No.: 14/064,338

(22) Filed: Oct. 28, 2013

(65) Prior Publication Data

US 2014/0187064 A1 Jul. 3, 2014

(30) Foreign Application Priority Data

Dec. 28, 2012 (CN) ..... 2012 1 0582400

(51) Int. Cl.
*H01R 12/70* (2011.01)

(52) U.S. Cl.
CPC ..... *H01R 12/7052* (2013.01)

(58) Field of Classification Search
CPC ..... H01R 23/7063; H01R 23/7057; H01R 23/7073; H01R 12/57; H01R 23/725; H01R 23/7042; H01R 23/702; H01R 13/504; H01R 13/6595; H01R 13/7026; H01R 23/7068; H01R 23/6873
See application file for complete search history.

(56) References Cited

U.S. PATENT DOCUMENTS

| | | | | |
|---|---|---|---|---|
| 5,171,165 | A * | 12/1992 | Hwang | 439/567 |
| 5,259,789 | A * | 11/1993 | Patel et al. | 439/570 |
| 6,227,906 | B1 * | 5/2001 | Fan | 439/570 |
| 6,334,789 | B1 * | 1/2002 | Koyama | 439/570 |
| 6,361,332 | B1 * | 3/2002 | Froude et al. | 439/83 |
| 6,679,727 | B1 * | 1/2004 | Yu | 439/567 |
| 7,048,576 | B2 * | 5/2006 | Nakano | 439/570 |
| 7,172,434 | B2 * | 2/2007 | Obikane et al. | 439/74 |
| 7,510,431 | B2 * | 3/2009 | Zhu et al. | 439/567 |
| 7,727,010 | B2 * | 6/2010 | Liu et al. | 439/570 |
| 7,972,171 | B2 * | 7/2011 | Teh | 439/567 |
| 2002/0042224 | A1 * | 4/2002 | Fan | 439/570 |
| 2008/0038958 | A1 * | 2/2008 | Xiang | 439/571 |

* cited by examiner

*Primary Examiner* — Gary Paumen
(74) *Attorney, Agent, or Firm* — Sughrue Mion, PLLC

(57) ABSTRACT

A low-profile electrical connector includes an insulative housing, a plurality of contacts and a pair of mounting pieces positioned at opposite sides of the insulative housing. The insulative housing includes a half-opened plug-receiving space. Each contact includes a fixing portion, a deformable contacting portion extending into the plug-receiving space and a soldering portion for being mounted to a circuit board. Each mounting piece includes a retaining portion, a bending portion extending sidewardly from the retaining portion and a mounting portion parallel to the retaining portion. The mounting portions are adapted for being fixed to the circuit board in order that when a plug is inserted into the plug-receiving space, the mounting portions replace the soldering portions to bear a great deal of impact force.

20 Claims, 14 Drawing Sheets

LOW-PROFILE ELECTRICAL CONNECTOR WITH IMPROVED MOUNTING PIECES FOR RESISTING IMPACT FORCE

BACKGROUND OF THE INVENTION

1. Field of the Invention

The present invention relates to an electrical connector, and more particularly to a low-profile RJ 45 connector with improved mounting pieces for resisting impact force so as to improve stable electrical connection with a circuit board.

2. Description of Related Art

With consumer's requirements of reduced size and light of electronic devices, superslim notebook computers begin to be newly presented in notebook computer market, which leads the whole notebook computer market to a thin trend. However, in order to realize light and thin appearance, it is a big problem for traditional standard electrical connectors to arrange their inner structures because of reduced height. For this reason, sink type electrical connectors are developed.

Currently, sink type RJ 45 connectors are integrally fixed to the circuit boards via the contacts soldered to the circuit boards. However, there is no directly fixation between the insulative housing of the RJ 45 connector and the circuit board. When a RJ 45 plug is inserted into the RJ 45 connector, the insertion force applied by the user is totally transferred to and endured by a soldering area where the contacts are soldered with the circuit board. As a result, the soldering area is easily broken so as to make the whole RJ 45 connector lose its function.

Hence, it is desirable to improve the conventional electrical connectors to solve the above problems.

BRIEF SUMMARY OF THE INVENTION

The present invention provides a low-profile electrical connector for being mounted to a circuit board. The electrical connector includes an insulative housing, a plurality of contacts retained in the insulative housing and a pair of mounting pieces positioned at opposite lateral sides of the insulative housing. The insulative housing includes a plug-receiving space which is not only downwardly opened through the circuit board along a vertical direction but also opened along a horizontal direction perpendicular to the vertical direction. The insulative housing includes a top wall, a rear wall and a pair of side walls with the plug-receiving space formed thereby. Each contact includes a fixing portion, a deformable contacting portion extending backwardly and slantly from the fixing portion, and a soldering portion for being mounted to the circuit board. The contacting portion extends into the plug-receiving space. Each mounting piece includes a retaining portion fixed to the corresponding side wall, a bending portion extending sidewardly from the retaining portion and a mounting portion further extending from the bending portion in such a manner that the mounting portion is parallel to the retaining portion. The mounting portions are adapted for being fixed to the circuit board in order that when a plug is inserted into the plug-receiving space, the mounting portions replace the soldering portions to bear a great deal of impact force. As a result, the soldering area of the contacts and the circuit board can be well protected.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
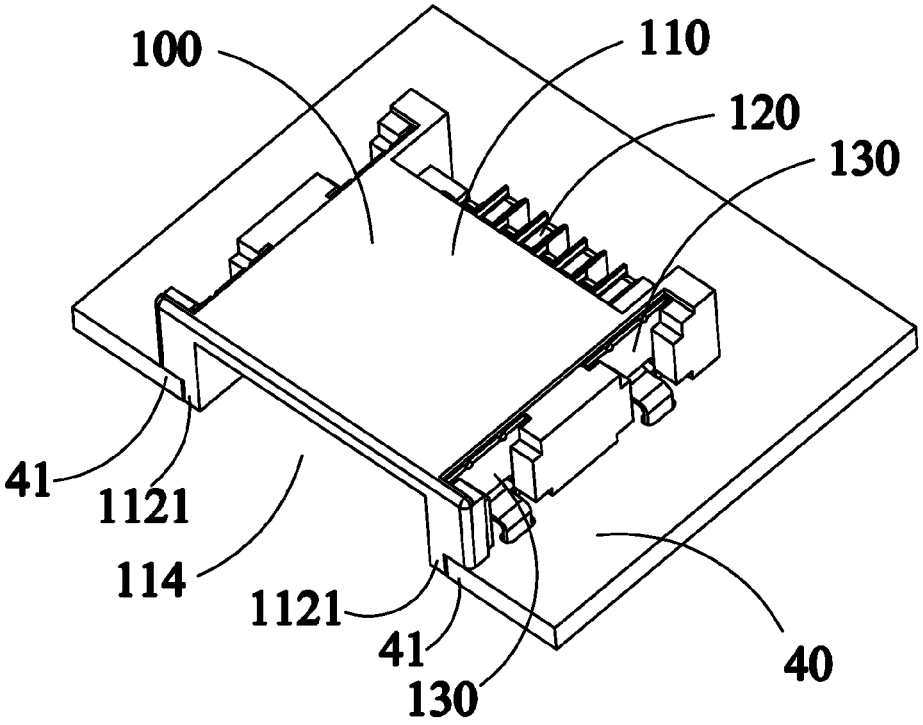
FIG. 1 is a perspective view of an electrical connector assembly with an electrical connector mounted on a circuit board in accordance with a first illustrated embodiment of the present invention.

Reference will now be made to the drawing figures to describe the embodiments of the present invention in detail. In the following description, the same drawing reference numerals are used for the same elements in different drawings.

Figure 2:
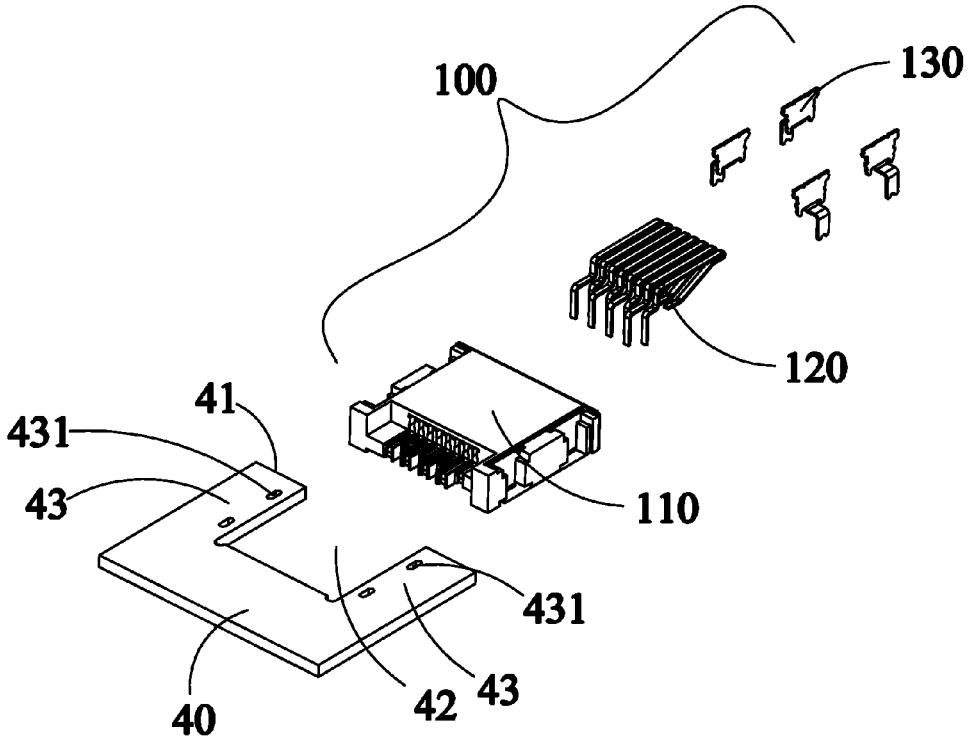
FIG. 2 is an exploded view of the electrical connector assembly as shown in FIG. 1.

Referring to FIGS. 1 and 2, the present invention discloses an electrical connector assembly including an electrical connector 100 and a circuit board 40 with the electrical connector 100 mounted thereto. According to the first illustrated embodiment of the present invention, the electrical connector 100 is a low-profile RJ 45 connector and includes an insulative housing 110, a plurality of contacts 120 retained in the insulative housing 110 and two pairs of mounting pieces 130 positioned at opposite lateral sides of the insulative housing 110.

Referring to FIGS. 1 and 2, the circuit board 40 includes a front edge 41, an opening 42 extending through the front edge 41 and a pair of side portions 43 at opposite sides of the opening 42. Each side portion 43 defines two mounting slits 431 which are in alignment with each other.

Referring to FIGS. 3 to 6, the insulative housing 110 includes a top wall 111, a pair of side walls 112 perpendicular to the top wall 111, and a rear wall 113 connecting the top wall and the side walls 112. The top wall 111, the pair of side walls 112 and the rear wall 113 jointly form a plug-receiving space 114 for receiving a plug (not shown). The plug-receiving space 114 is half-opened to be exposed to the air. According to the first illustrated embodiment of the present invention, the plug-receiving space 114 is not only downwardly opened through the circuit board 40 along a vertical direction, but also opened along a horizontal direction (i.e. a rear-to-front direction as shown in FIG. 1) perpendicular to the vertical direction.

Figure 3:
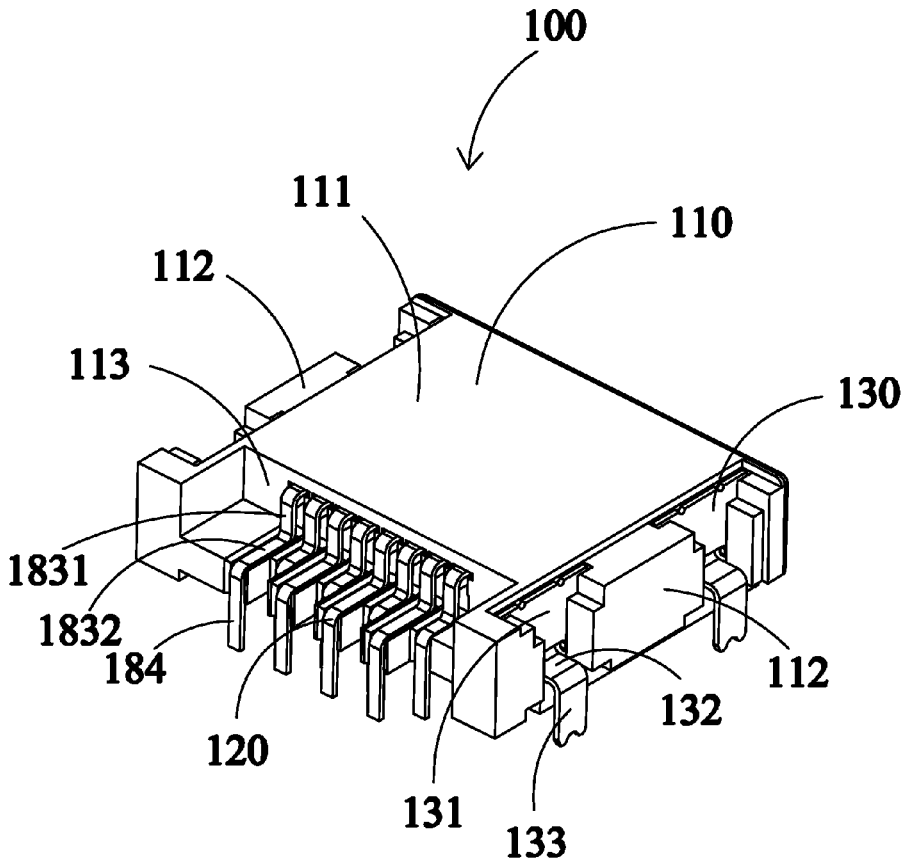
FIG. 3 is a perspective view of the electrical connector as shown in FIG. 1.
Figure 4:
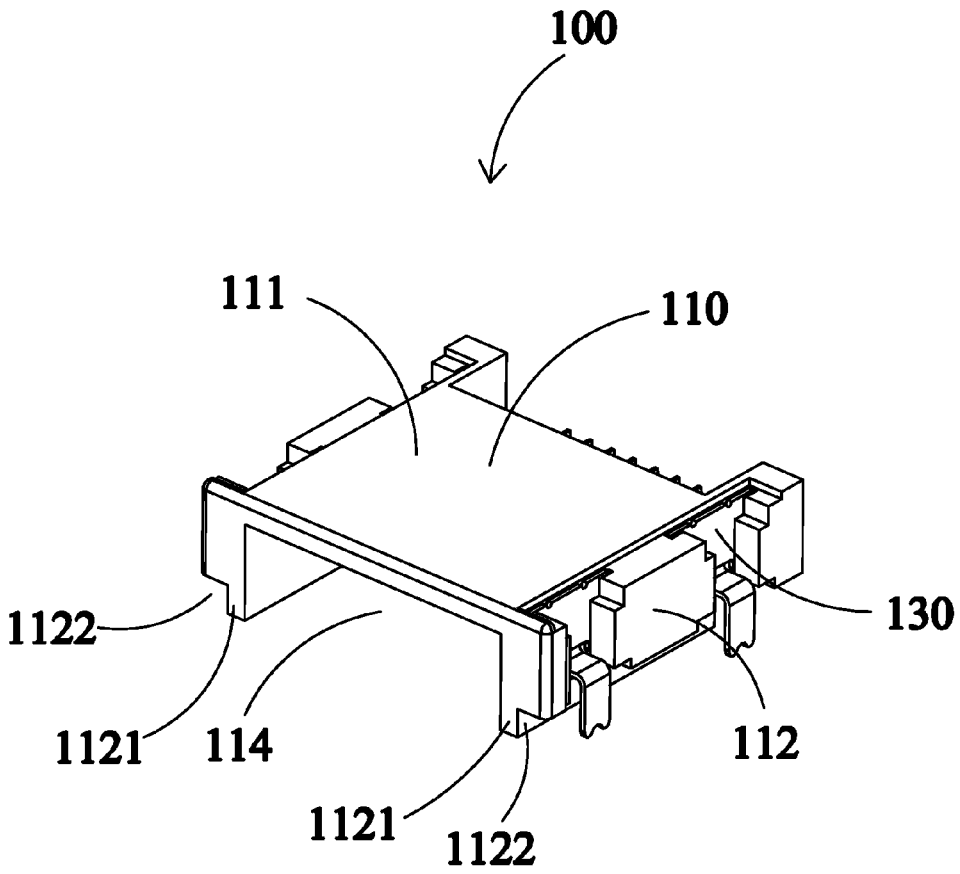
FIG. 4 is another perspective view of the electrical connector as shown in FIG. 3.

Referring to FIGS. 3 and 4, the insulative housing 110 is symmetrical along a center line (not shown) along the horizontal direction. Each side wall 112 includes a pair of fixing slits 161 to fasten corresponding mounting pieces 130. Each fixing slit 161 is of a T-shaped configuration from a top view and includes an inner slit 162 and an outer slit 163 in communication with each other. The inner slit 162 extends through the side wall 112 along the vertical direction. The outer slit 163 not only extends through the side wall 112 along the vertical direction but also extends outwardly through the side wall 112 along a sideward direction (i.e. a left and right direction) perpendicular to the vertical direction and the horizontal direction. Besides, each side wall 112 includes a protrusion portion 1121 extending downwardly from an inner side thereof and simultaneously forming a sideward and outward cutout 1122. The plug-receiving space 114 is restricted by the protrusion portions 1121.

Figure 5:
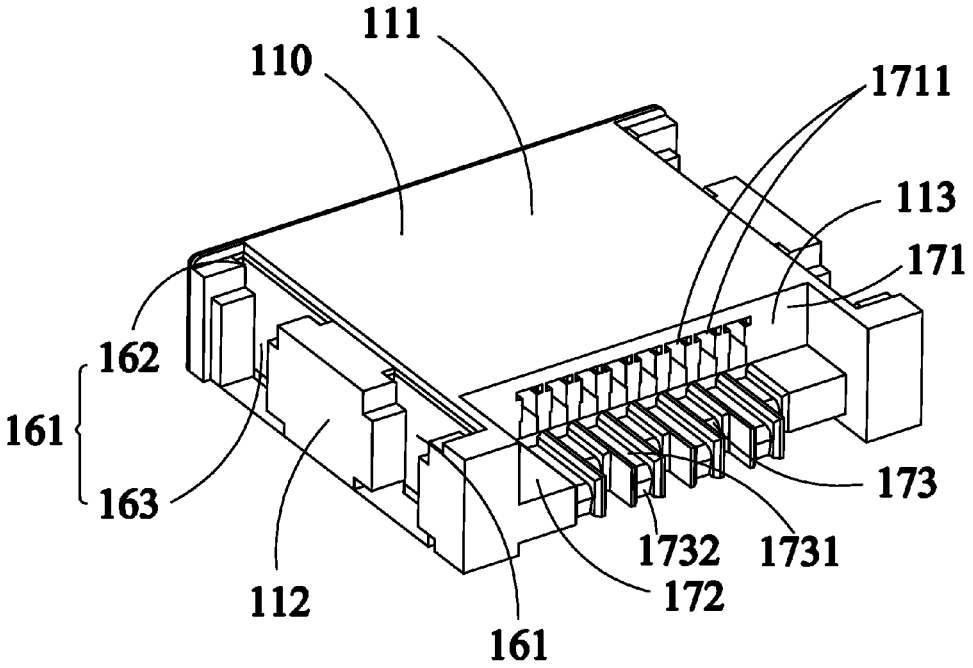
FIG. 5 is a perspective view of an insulative housing of the electrical connector as shown in FIG. 3.
Figure 6:
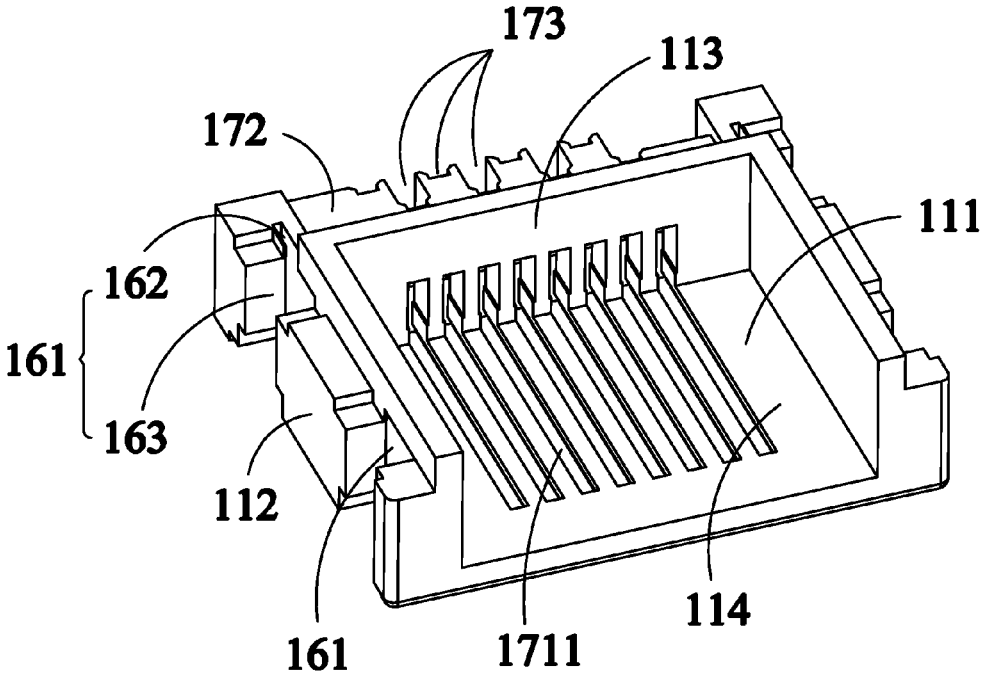
FIG. 6 is another perspective view of the insulative housing as shown in FIG. 5.

Referring to FIGS. 5 and 6, the rear wall 113 includes a vertical platform 171 defining a plurality of passageways 1711 extending therethrough and a horizontal platform 172 defining a plurality of grooves 173 corresponding to the passageways 1711. The passageways 1711 further extend forwardly to be formed on a bottom surface of the top wall 111 as well (shown in FIG. 6). As a result, utilizing the inner space of the top wall 111 to receiving the contacts 120, the height of the electrical connector 100 can be decreased. Each groove 173 includes a horizontal groove 1731 and a vertical groove 1732 in communication with each other. As shown in FIG. 5, lengths of the horizontal grooves 1731 along the horizontal direction are different, and the horizontal grooves 1731 of the same length are alternately arranged with each other.

Figure 7:
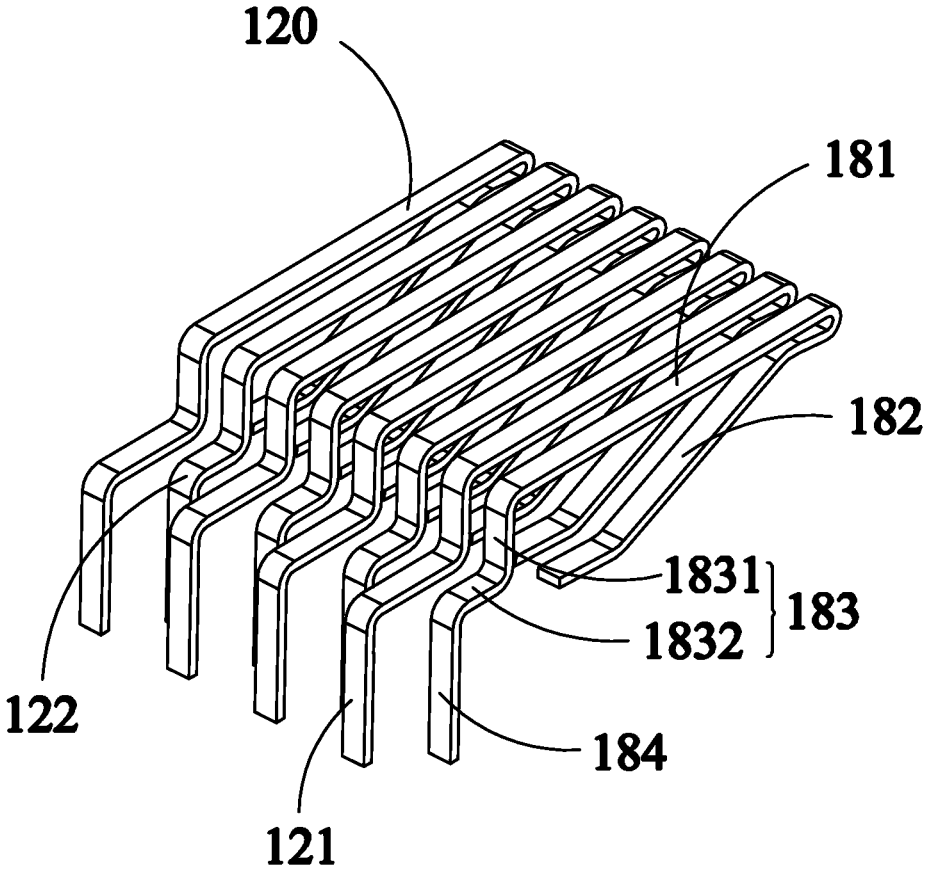
FIG. 7 is a perspective view of contacts of the electrical connector as shown in FIG. 3.
Figure 8:
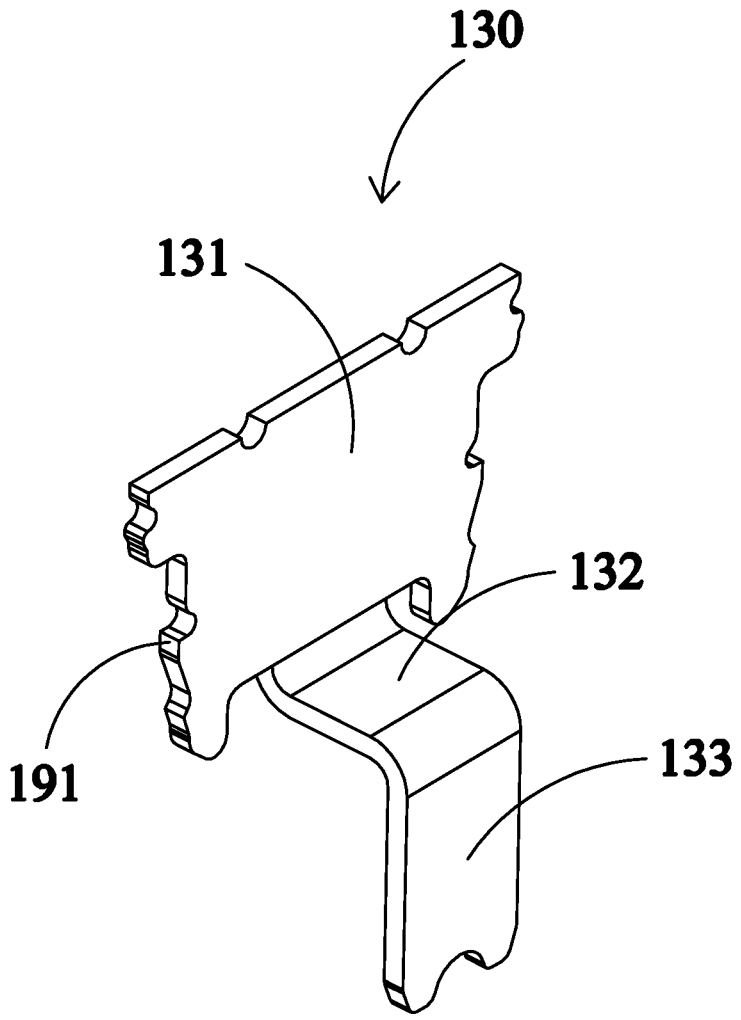
FIG. 8 is a perspective view of a mounting piece of the electrical connector as shown in FIG. 3.

Referring to FIG. 7, the contacts 120 include a plurality of first contacts 121 and a plurality of second contacts 122 alternately arranged with each other along the sideward direction. Each contact 120 includes a fixing portion 181 fixed in the passageways 1711, a deformable contacting portion 182 extending backwardly and slantly from a front end of the fixing portion 181, a L-shaped portion 183 bent from a rear end of the fixing portion 181, and a soldering portion 184 bent downwardly from the L-shaped portion 183 for being mounted to the circuit board 40. The contacting portions 182 extend into the plug-receiving space 114 for mating with the plug. The L-shaped portion 183 includes a vertical portion 1831 located below the fixing portion 181 and a horizontal portion 1832 positioned in the horizontal groove 1731. Each soldering portion 184 is positioned in the vertical groove 1831. The soldering portions 184 of the contacts 120 are regulated along the horizontal direction in at least two rows.

Referring to FIGS. 1 to 8, the mounting pieces 130 are separately made from the insulative housing 110 and the mounting pieces 130 are then assembled to the insulative housing 110. According to the first illustrated embodiment of the present invention, each mounting piece 130 includes a retaining portion 131 fixed to corresponding fixing slit 161 of the side wall 112, a bending portion 132 extending sidewardly from a bottom of the retaining portion 131 and a mounting portion 133 further extending from the bending portion 132 in such a manner that the mounting portion 133 is parallel to the retaining portion 131. The mounting portion 133 is separated a distance from the retaining portion 131 by the bending portion 132 along the sideward direction perpendicular to the vertical direction and the horizontal direction. The mounting portion 133 and the retaining portion 131 are located at opposite sides of the bending portion 132 along the vertical direction. In assembling, each mounting piece 130 is downwardly inserted into corresponding fixing slit 161. The retaining portion 131 is fixed in the inner slit 162. The retaining portion 131 is wider than the mounting portion 133 and the bending portion 132 for securely fixation. Besides, the retaining portion 131 includes a plurality of barbs 191 to rigidly engage with an inner side of the inner slit 162 for stable fixation as well. The bending portion 132 passes through the outer slit 163 to reach a bottom side of the fixing slit 161. The mounting portion 133 extends downwardly beyond the insulative housing 110 to be inserted into the mounting slits 431 of the circuit board 40 along a top-to-bottom direction.

When the electrical connector 100 is mounted to the circuit board 40, the insulative housing 110 is at least partly received in the opening 42 of the circuit board 40. Referring to FIG. 1, the protrusion portions 1121 of the side walls 112 downwardly extend into the opening 42 as a result that the height of the electrical connector assembly can be decreased. Preferably, bottom surfaces of the protrusion portions 1121 are coplanar with a bottom surface of the circuit board 40. Besides, the side portions 43 of the circuit board 40 are partly received in the cutouts 1122 so as to support the electrical connector 100. The opening 42 is wider than the plug-receiving space 114. The mounting portions 133 are fixed to the circuit board 40 in order that when the plug is inserted into the plug-receiving space 114, the mounting portions 133 replace the soldering portions 184 to bear a great deal of impact force. As a result, the soldering area of the contacts 120 and the circuit board 40 can be well protected.

Figure 9:
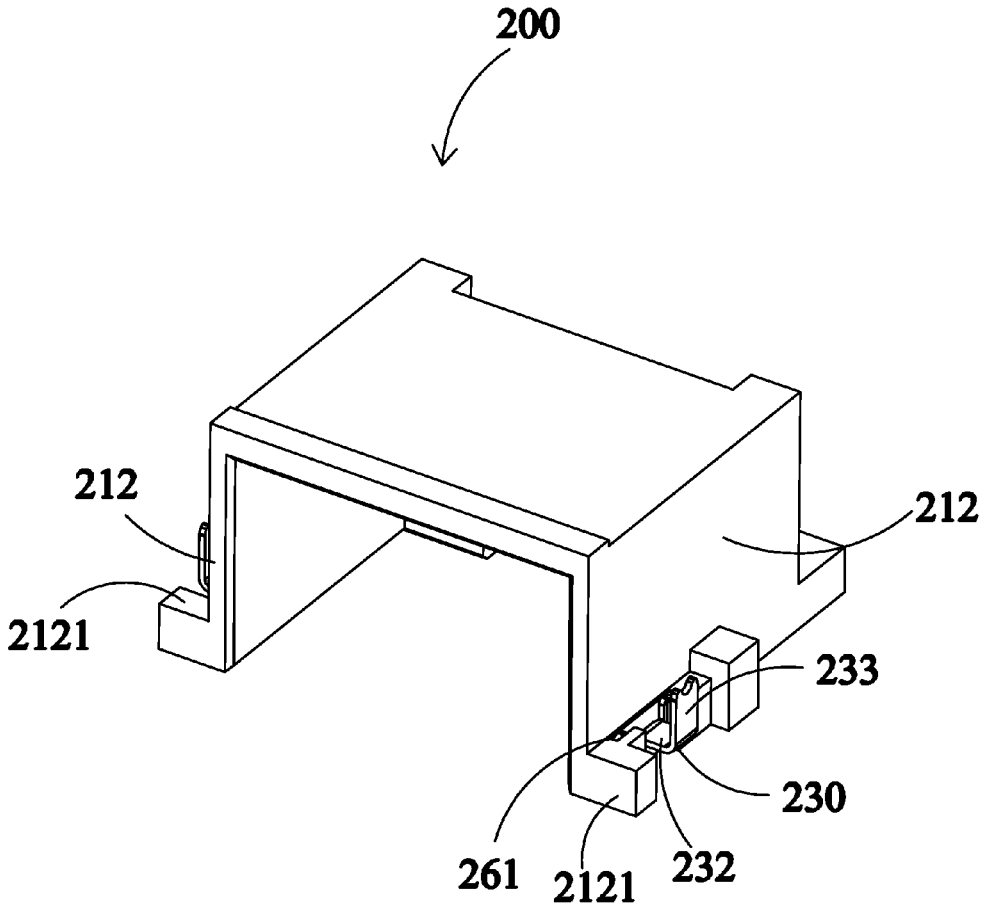
FIG. 9 is a perspective view of another electrical connector in accordance with a second illustrated embodiment of the present invention.
Figure 10:
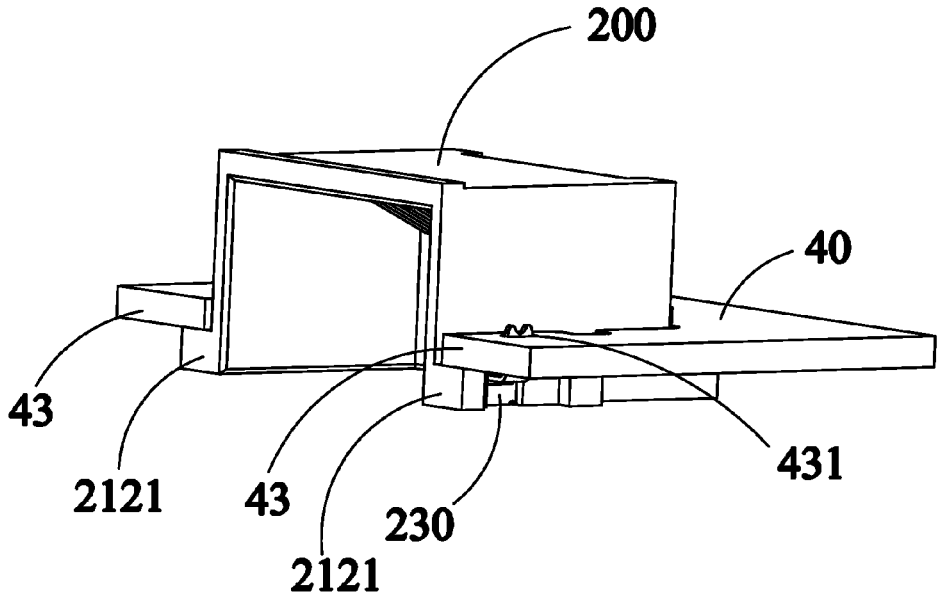
FIG. 10 is a perspective view of another electrical connector assembly with the electrical connector mounted on a circuit board in accordance with a second illustrated embodiment of the present invention.
Figure 11:
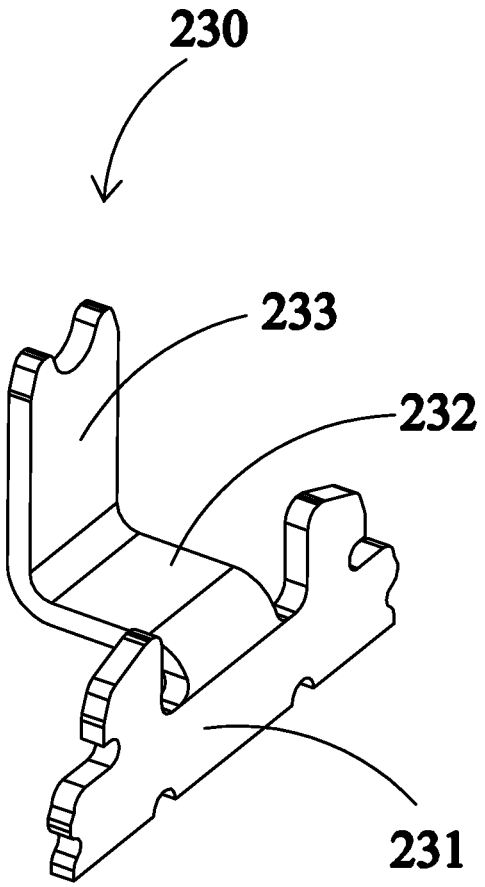
FIG. 11 is a perspective view of a mounting piece of the electrical connector as shown in FIG. 9 in accordance with a second illustrated embodiment of the present invention.

Referring to FIGS. 9 to 11, another electrical connector assembly according to the second embodiment of the present invention is disclosed. Since the electrical connector 200 of the second embodiment is similar to the electrical connector 100 of the first embodiment, the same structure thereof are omitted hereinafter and only the differences therebetween will be described in detail.

Referring to FIGS. 9 to 11, the bending portion 232 extends sidewardly from a top of the retaining portion 231. The mounting portion 233 further extends upwardly from the bending portion 232. The protrusion portion 2121 extend sidewardly and outwardly from the side wall 212. In assembly the mounting pieces 230 are upwardly inserted into the fixing slits 261. The electrical connector 200 is mounted to the circuit board 40 from a bottom-to-top direction. The mounting portions 233 are inserted into the mounting slits 431 of the circuit board 40 along the bottom-to-top direction. The protrusion portions 2121 are located under the side portions 43 so as to upwardly support the circuit board 40.

Figure 12:
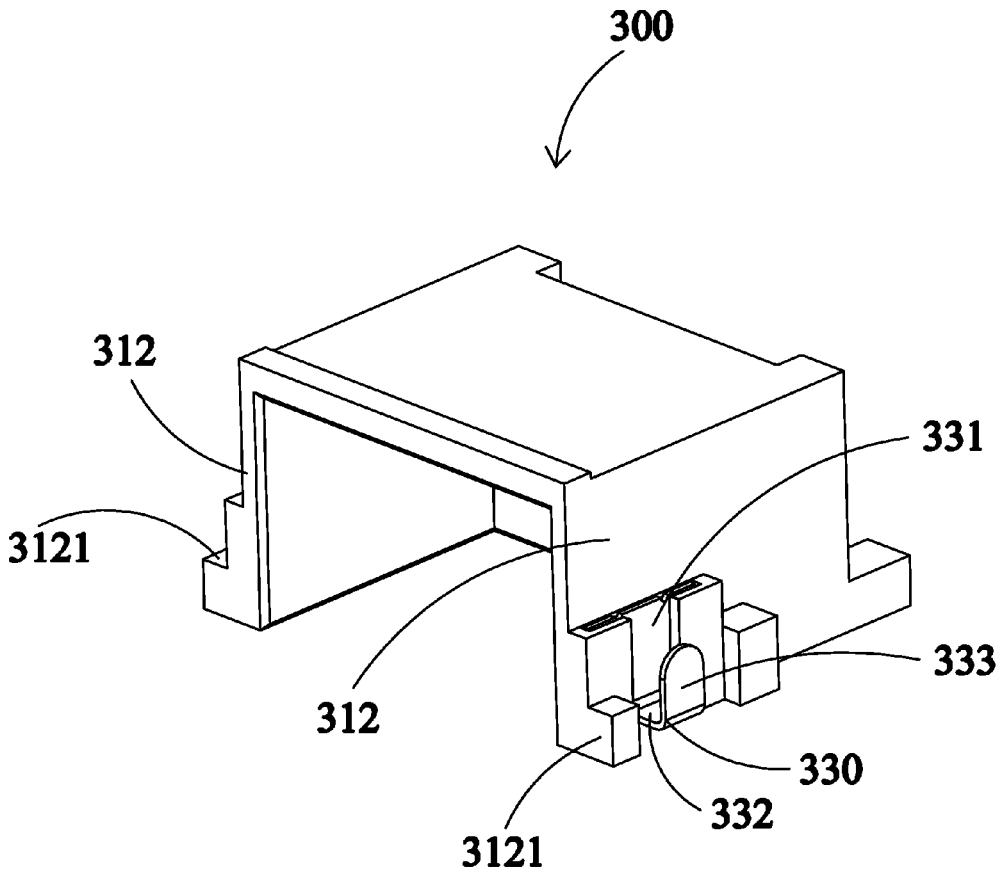
FIG. 12 is a perspective view of another electrical connector in accordance with a third illustrated embodiment of the present invention.
Figure 13:
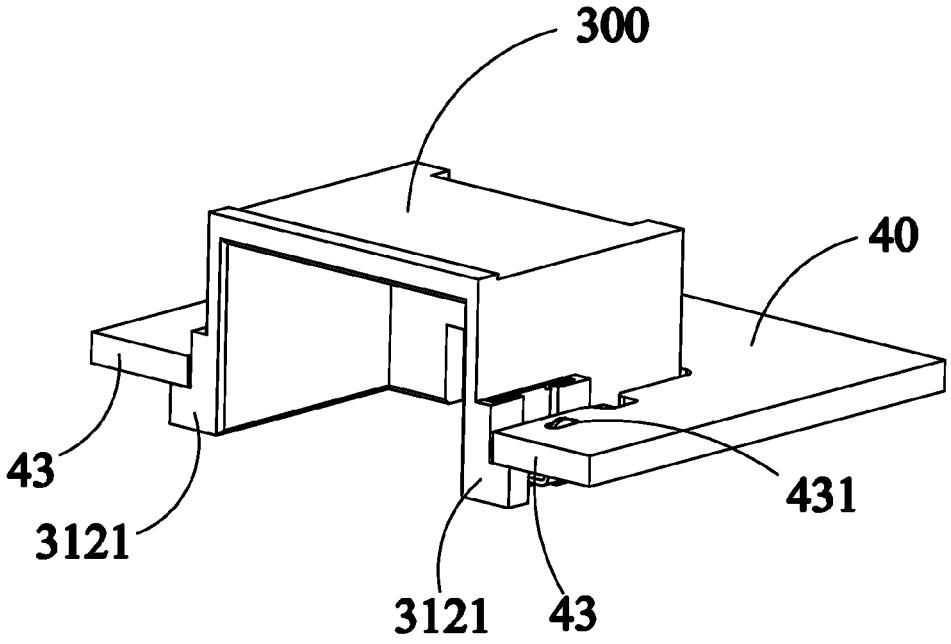
FIG. 13 is a perspective view of another electrical connector assembly with the electrical connector mounted on a circuit board in accordance with a third illustrated embodiment of the present invention.
Figure 14:
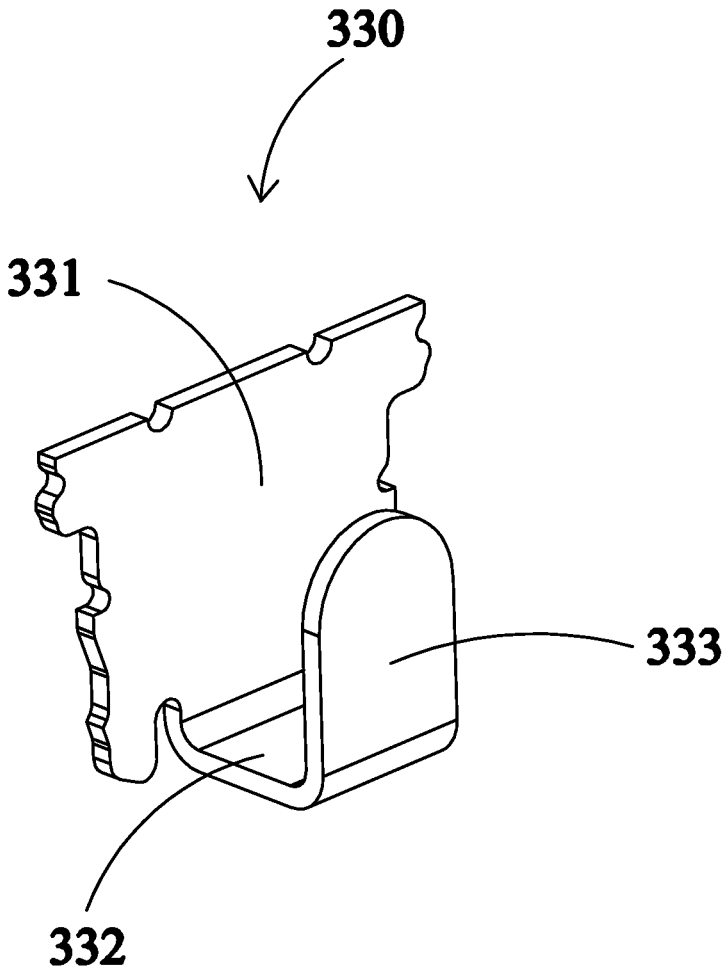
FIG. 14 is a perspective view of a mounting piece of the electrical connector as shown in FIG. 12 in accordance with a third illustrated embodiment of the present invention.

Referring to FIGS. 12 to 14, another electrical connector assembly according to the third embodiment of the present invention is disclosed. Since the electrical connector 300 of the second embodiment is similar to the electrical connector 100 of the first embodiment, the same structure thereof are omitted hereinafter and only the differences therebetween will be described in detail.

Referring to FIGS. 12 to 14, the mounting portion 333 extends upwardly from the bending portion 332 so that the mounting portion 333 and the retaining portion 331 are located at a same side of the bending portion 332 along the vertical direction. The protrusion portion 3121 extend sidewardly and outwardly from the side wall 312. The electrical connector 300 is mounted to the circuit board 40 from a bottom-to-top direction. The mounting portions 333 are inserted into the mounting slits 431 of the circuit board 40 along the bottom-to-top direction. The protrusion portions 3121 are located under the side portions 43 so as to upwardly support the circuit board 40.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A low-profile electrical connector for being mounted to a circuit board, comprising:

an insulative housing comprising a plug-receiving space which is not only downwardly opened through the circuit board along a vertical direction but also opened along a horizontal direction perpendicular to the vertical direction, the insulative housing comprising a top wall, a rear wall and a pair of side walls with the plug-receiving space formed thereby;

a plurality of contacts each comprising a fixing portion, a deformable contacting portion extending backwardly and slantly from the fixing portion, and a soldering portion for being mounted to the circuit board, the contacting portion extending into the plug-receiving space; and a pair of mounting pieces positioned at opposite lateral sides of the insulative housing, each mounting piece being fixed to corresponding side wall of the insulative housing; wherein each mounting piece comprises a retaining portion fixed to the corresponding side wall, a bending portion extending sidewardly from the retaining portion and a mounting portion further extending from the bending portion in such a manner that the mounting portion is parallel to the retaining portion; and wherein the mounting portions are adapted for being fixed to the circuit board in order that when a plug is inserted into the plug-receiving space, the mounting portions replace the soldering portions to bear a great deal of impact force.

2. The low-profile electrical connector as claimed in claim 1, wherein the mounting portion is separated a distance from the retaining portion by the bending portion along a sideward direction perpendicular to the vertical direction and the horizontal direction.

3. The low-profile electrical connector as claimed in claim 1, wherein the mounting pieces are separately made from the insulative housing and the mounting pieces are assembled to the insulative housing, each side wall of the insulative housing defining a fixing slit to fasten corresponding mounting piece.

4. The low-profile electrical connector as claimed in claim 3, wherein the mounting portion and the retaining portion are located at opposite sides of the bending portion along the vertical direction.

5. The low-profile electrical connector as claimed in claim 4, wherein the bending portion extends sidewardly from a bottom of the retaining portion, and the pair of mounting pieces are downwardly inserted into the fixing slits.

6. The low-profile electrical connector as claimed in claim 4, wherein the bending portion extends sidewardly from a top of the retaining portion, and the pair of mounting pieces are upwardly inserted into the fixing slits.

7. The low-profile electrical connector as claimed in claim 3, wherein the mounting portion and the retaining portion are located at a same side of the bending portion along the vertical direction.

8. The low-profile electrical connector as claimed in claim 7, wherein the bending portion extends sidewardly from a bottom of the retaining portion, and the pair of mounting pieces are downwardly inserted into the fixing slits.

9. The low-profile electrical connector as claimed in claim 3, wherein the retaining portion is wider than the mounting portion and the bending portion, and the retaining portion comprises a plurality of barbs to rigidly engage with an inner side of the fixing slit.

10. The low-profile electrical connector as claimed in claim 9, wherein each fixing slit is of a T-shaped configuration from a top view, each fixing slit comprising an inner slit to fix the retaining portion and an outer slit through which the bending portion passes, the inner slit extending through the side wall along the vertical direction, the outer slit not only extending through the side wall along the vertical direction but also extending outwardly through the side wall along a sideward direction perpendicular to the vertical direction, the inner slit and the outer slit being in communication with each other.

11. The low-profile electrical connector as claimed in claim 1, wherein the rear wall comprises a vertical platform defining a plurality of passageways extending therethrough and a horizontal platform comprising a plurality of grooves corresponding to the passageways, the passageways further extending forwardly to be formed on a bottom surface of the top wall as well, the fixing portions of the contacts being received in the passageways, each groove comprising a horizontal groove and a vertical groove in communication with each other, each contact further comprising a L-shaped portion connected between the fixing portion and the soldering portion, the L-shaped portion comprising a vertical portion located below the fixing portion and a horizontal portion positioned in the horizontal groove, each soldering portion being positioned in the vertical groove.

12. The low-profile electrical connector as claimed in claim 11, wherein lengths of the horizontal grooves along the horizontal direction are different, and the horizontal grooves of the same length are alternately arranged with each other so that the soldering portions of the contacts are regulated along the horizontal direction in at least two rows.

13. An electrical connector assembly comprising:

a circuit board and an electrical connector mounted to the circuit board;

the circuit board comprising a front edge, an opening extending through the front edge and a pair of side portions at opposite sides of the opening, each side portion defining a mounting slit;

the electrical connector comprising:

an insulative housing at least partly received in the opening and comprising a top wall, a pair of side walls and a plug-receiving space formed thereby, the opening being wider than the plug-receiving space;

a plurality of contacts each comprising a fixing portion, a deformable contacting portion extending into the plug-receiving space and a soldering portion mounted to the circuit board; and a pair of mounting pieces fixed to the pair of side walls of the insulative housing, each mounting piece comprising a retaining portion fixed to the corresponding side wall, a bending portion extending sidewardly from the retaining portion and a mounting portion further extending from the bending portion in such a manner that the mounting portion is parallel to the retaining portion; wherein the mounting portions extend through the mounting slits and are fixed to the circuit board in order that when a plug is inserted into the plug-receiving space, the mounting portions replace the soldering portions to bear a great deal of impact force.

14. The electrical connector assembly as claimed in claim 13, wherein each side wall comprises a protrusion portion extending downwardly from an inner side thereof and simultaneously forming a sideward and outward cutout, the protrusion portions downwardly extending into the opening, the plug-receiving space being restricted by the protrusion portions, the side portions of the circuit board being partly received in the cutouts so as to support the electrical connector.

15. The electrical connector assembly as claimed in claim 14, wherein bottom surfaces of the protrusion portions are coplanar with a bottom surface of the circuit board, the mounting portions of the mounting pieces being inserted into the mounting slits along a top-to-bottom direction.

16. The electrical connector assembly as claimed in claim 13, wherein each side wall comprises a protrusion portion extending sidewardly and outwardly therefrom, the protrusion portions being located under the side portions so as to upwardly support the circuit board.

17. The electrical connector assembly as claimed in claim 13, wherein the mounting pieces are separately made from the insulative housing and the mounting pieces are assembled to the insulative housing, each side wall of the insulative housing defining a fixing slit to receive corresponding mounting piece, the retaining portion being wider than the mounting portion and the bending portion, the retaining portion comprising a plurality of barbs to rigidly engage with an inner side of the fixing slit.

18. The electrical connector assembly as claimed in claim 17, wherein each fixing slit is of a T-shaped configuration from a top view, each fixing slit comprising an inner slit to fix the retaining portion and an outer slit through which the bending portion passes, the inner slit extending through the side wall along a vertical direction, the outer slit not only extending through the side wall along the vertical direction but also extending outwardly through the side wall along a sideward direction perpendicular to the vertical direction, the inner slit and the outer slit being in communication with each other.

19. The electrical connector assembly as claimed in claim 13, wherein the mounting portion and the retaining portion are located at opposite sides of the bending portion along a vertical direction.

20. The electrical connector assembly as claimed in claim 13, wherein the mounting portion and the retaining portion are located at a same side of the bending portion along a vertical direction.

* * * * *